US008800510B2

(12) United States Patent
Carlson et al.

(10) Patent No.: US 8,800,510 B2
(45) Date of Patent: Aug. 12, 2014

(54) INTERNAL COMBUSTION ENGINE FOR A VEHICLE COMPRISING AT LEAST ONE COMPRESSOR CYLINDER AT LEAST ONE COMPRESSOR CYLINDER CONNECTED TO A COMPRESSED-AIR TANK

(75) Inventors: Urban Carlson, Helsingborg (SE); Anders Höglund, Munka Ljungby (SE); Christian Von Koenigsegg, Vejbystrand (SE)

(73) Assignee: Freevalve AB, Angelholm (SE)

( * ) Notice: Subject to any disclaimer, the term of this patent is extended or adjusted under 35 U.S.C. 154(b) by 0 days.

(21) Appl. No.: 13/704,833

(22) PCT Filed: Jun. 23, 2011

(86) PCT No.: PCT/SE2011/050837
§ 371 (c)(1),
(2), (4) Date: Dec. 17, 2012

(87) PCT Pub. No.: WO2011/162714
PCT Pub. Date: Dec. 29, 2011

(65) Prior Publication Data

US 2013/0098337 A1 Apr. 25, 2013

(30) Foreign Application Priority Data

Jun. 24, 2010 (SE) ..... 1050687

(51) Int. Cl.
*F01L 9/02* (2006.01)

(52) U.S. Cl.
USPC ..... 123/90.14; 123/52.2; 123/70 R

(58) Field of Classification Search
CPC ..... F02B 33/22; F02B 33/44; F02B 75/04; F02B 37/00; F01L 1/465; F01L 9/025
USPC ..... 123/90.14, 52.2, 559.1, 70 R, 71 R, 72
See application file for complete search history.

(56) References Cited

U.S. PATENT DOCUMENTS

| | | | | |
|---|---|---|---|---|
| 6,223,846 | B1 | 5/2001 | Schechter | |
| 7,603,970 | B2 * | 10/2009 | Scuderi et al. | 123/68 |
| 2006/0207257 | A1 | 9/2006 | Turner et al. | |
| 2007/0157894 | A1 | 7/2007 | Scuderi et al. | |
| 2010/0282225 | A1 | 11/2010 | Gilbert et al. | |

OTHER PUBLICATIONS

International Search Report, dated Oct. 11, 2011, from corresponding PCT application.

* cited by examiner

*Primary Examiner* — Hung Q Nguyen
(74) *Attorney, Agent, or Firm* — Young & Thompson

(57) ABSTRACT

An internal combustion engine includes a working cylinder (2) including an inlet valve (6) and an adherent pneumatic inlet valve actuator (8), an outlet valve (7) and an adherent pneumatic outlet valve actuator (9), and a working piston (4), a compressor cylinder (3) including an inlet valve (10), an outlet valve (11), and a compressor piston (5) operated by the working piston (4), a compressed-air tank (14) connected to the compressor cylinder (3) via a first compressed-air conduit (15), and a second compressed-air conduit (16) that extends from the first compressed-air conduit (15), the first inlet valve actuator (8) and the outlet valve actuator (9) of the working cylinder (2) being connected to the second compressed-air conduit (16).

20 Claims, 7 Drawing Sheets

INTERNAL COMBUSTION ENGINE FOR A VEHICLE COMPRISING AT LEAST ONE COMPRESSOR CYLINDER AT LEAST ONE COMPRESSOR CYLINDER CONNECTED TO A COMPRESSED-AIR TANK

TECHNICAL FIELD OF THE INVENTION

The present invention relates in general to an internal combustion engine for a vehicle. In specific the present invention relates to a internal combustion engine for a vehicle, comprising at least two cylinders, a moveably arranged piston being arranged in each cylinder in order to increase and decrease, respectively, a volume defined jointly by the cylinder and the piston, and a compressed-air tank connected to at least one of said at least two cylinders.

BACKGROUND OF THE INVENTION AND PRIOR ART

Internal combustion engines for vehicles have been available since the middle of the 1800-century and have all the time been the object of development driven forward concurrently with the development of the manufacturing industries. However, during the last decades the public have put forward great demands upon faster development of more environment friendly and fuel efficient internal combustion engines concurrently with the increase in the fuel price.

Today, there are present some valiant attempts to develop fuel efficient internal combustion engines with retained performance. One example is an internal combustion engine that, when the driver does not step on the gas, act as an air compressor that the crankshaft of the internal combustion engine is impelled/rotated by the fact that the wheels of the vehicle rotates, and thereby the pistons are displaced in their cylinders. This result in that an air pressure is produced instead of exhaust gases, and this compressed-air is stored in a compressed-air tank. The compressed-air is later on used, when the driver once again steps on the gas, to displace the pistons in their cylinders and thereby to impel/rotate the crankshaft of the internal combustion engine in order to turn the wheels of the vehicle. Thus, no fuel is used to propel the vehicle until the pressure in the compressed-air tank has reached a predetermined minimum level.

Moreover, it can be a problem of internal combustion engines that vibrations arises in the vehicle as well as in the power train of the vehicle due to the fact that the combustion pulse moment arising in the cylinders of the internal combustion engine upon combustion therein is not in balance due to the fact that the symmetry of the combustion pulse pattern of the internal combustion engine cannot be achieved for one reason or another.

OBJECT OF THE INVENTION

The present invention aims at providing an improved internal combustion engine. A primary object of the invention is to provide an improved internal combustion engine of initially defined type, which continuously produce compressed-air.

Another object of the invention is to provide an internal combustion engine, that uses the produced compressed-air in order to operate pneumatic inlet valve actuators and outlet valve actuators.

It is another object of the present invention to provide an internal combustion engine, that admit storage of the kinetic energy the vehicle possesses when it is in motion and the driver does not step on the gas, in order to use it later on.

It is another object of the present invention to provide an internal combustion engine, that admit use of a super charger optimized for large exhaust gas flows without the arise of turbo lag/delay.

It is another object of the present invention to provide an internal combustion engine, that readily can be manufactured by converting an existing internal combustion engine.

SUMMARY OF THE INVENTION

According to the invention at least the primary object is attained by the initially defined internal combustion engine, which is characterized in that said at least two cylinders comprises at least one working cylinder and at least one compressor cylinder, the working cylinder comprising a first inlet opening and a first inlet valve arranged to open and close said first inlet opening, a first pneumatic inlet valve actuator operating the first inlet valve, an outlet opening and an outlet valve arranged to open and close said outlet opening, a pneumatic outlet valve actuator operating said outlet valve, and a working piston moveably arranged in the working cylinder, the compressor cylinder comprising a first inlet opening and a first inlet valve arranged to open and close said first inlet opening, an outlet opening and an outlet valve arranged to open and close said outlet opening, and a compressor piston moveably arranged in the compressor cylinder and operatively connected to and operated by the working piston, the compressed-air tank is connected to the outlet opening of the compressor cylinder via a first compressed-air conduit, the internal combustion engine also comprising a second compressed-air conduit that extends from said first compressed-air conduit and that comprise a first flow valve arranged to open and close the fluid communication from said first compressed-air conduit to said second compressed-air conduit, the first inlet valve actuator and the outlet valve actuator of the working cylinder being connected to the second compressed-air conduit.

Thus the present invention is based on the insight that by always using one of the cylinders of the internal combustion engine as a compressor cylinder, compressed-air continuously can be produced which is a prerequisite to commercially be able to use internal combustion engines having pneumatic inlet valve actuators and outlet valve actuators.

Preferred embodiments of the present invention are further defined in the dependent claims.

Preferably the compressor cylinder also comprises a first pneumatic inlet valve actuator operating the first inlet valve, said first inlet valve actuator of the compressor cylinder being connected to the second compressed-air conduit. This entail that it can also be controlled when the compressor cylinder shall be active and inactive, respectively.

Preferable the first compressed-air conduit comprises regenerator that is located between the outlet valve of the compressor cylinder and the compressed-air tank. The advantage of using a regenerator is that the warm compressed-air from the compressor cylinder heats the regenerator at the same time as the compressed-air is cooled down which entail that more compressed-air can be stored in a compressed-air tank of given size. According to another preferred embodiment the second compressed-air conduit is connected to the first compressed-air conduit between the regenerator and the outlet valve of the compressor cylinder, which entail that the compressed-air that is lead to the inlet valve actuators and the outlet valve actuators is first lead through the regenerator in order to heated once again. The advantage of leading warm compressed-air to the inlet valve actuators and the outlet valve actuators is that the compressed-air when heated expands and thus lasts to more activations of the inlet valve actuators and outlet valve actuators.

According to a preferred embodiment the second compressed-air conduit comprises a second flow valve, the outlet valve actuator of the working cylinder being arranged upstream said second flow valve, and the first pneumatic inlet valve actuator of the working cylinder and the first pneumatic inlet valve actuator of the compressor cylinder being arranged downstream said second flow valve. This configuration admit that the outlet valve actuator can be supplied with compressed-air having higher pressure than the inlet valve actuators, which is desirable when inwardly opened valves are used since the pressure in the cylinders is bigger when the outlet valves are about to be opened than when the inlet valves are to be opened.

In a preferred embodiment the first inlet opening of the working cylinder is connected to a first inlet manifold, in which an ejector nozzle mouths, a third compressed-air conduit extends from the compressed-air tank to said ejector nozzle, said third compressed-air conduit comprising a maneuverable flow valve that is arranged to open and close fluid communication from the compressed-air tank to the ejector nozzle. This result in that compressed-air by choice can be supplied to the inlet valves which gives a higher fill ratio in the working cylinders.

According to a preferred embodiment the first inlet opening of the working cylinder is connected to the first inlet manifold, in that the outlet opening of the working cylinder is connected to an outlet manifold, and in that the internal combustion engine also comprises a super charger, the outlet manifold being connected to an inlet of a turbine housing of the super charger, the inlet manifold is connected to an outlet of a compressor housing of the super charger via a second air supply conduit, and an inlet of said compressor housing is connected to an air inlet.

According to a more preferred embodiment said first air supply conduit comprising a maneuverable flow distribution valve that is connected to the second air supply conduit and that is arranged to alternating admit flow communication between, the first inlet opening of the compressor cylinder and the air inlet, and the first inlet opening of the compressor cylinder and the second air supply conduit, respectively. Thereby, the compressor cylinder can be feed air from the air inlet or from the super charger, depending on which air source having the highest of most suitable pressure at the moment.

According to a more preferred embodiment the working cylinder also comprises a second inlet opening and a second inlet valve arranged to open and close said second inlet opening, which is connected to a second inlet manifold, in that the compressor cylinder also comprises a second inlet opening and a second inlet valve arranged to open and close said second inlet opening, which is connected to said second inlet manifold, the second inlet manifold being connected to said second air supply conduit via a maneuverable flow distribution valve, and a third compressed-air conduit extending from the compressed-air tank to said maneuverable flow distribution valve that is arranged to alternating admit flow communication between, the second air supply conduit and the second inlet manifold, and the compressed-air tank and the second inlet manifold, respectively. This entail that the compressed-air in the compressed-air tank can be used to be expanded in the working cylinders and at the same time be feed to the compressor cylinder, whereupon the internal combustion engine is driven by the compressed-air instead of a combustion of a fuel-air-mixture.

Further advantages with and features of the invention will be apparent from the other dependent claims as well as from the following detailed description of preferred embodiments.

BRIEF DESCRIPTION OF THE DRAWINGS

A more complete understanding of abovementioned and other features and advantages of the present invention will be apparent from the following, detailed description of preferred embodiments in conjunction with the appended drawings, wherein.

DETAILED DESCRIPTION OF PREFERRED EMBODIMENTS

The present invention relates in general to a internal combustion engine for a vehicle.

Figure 1:
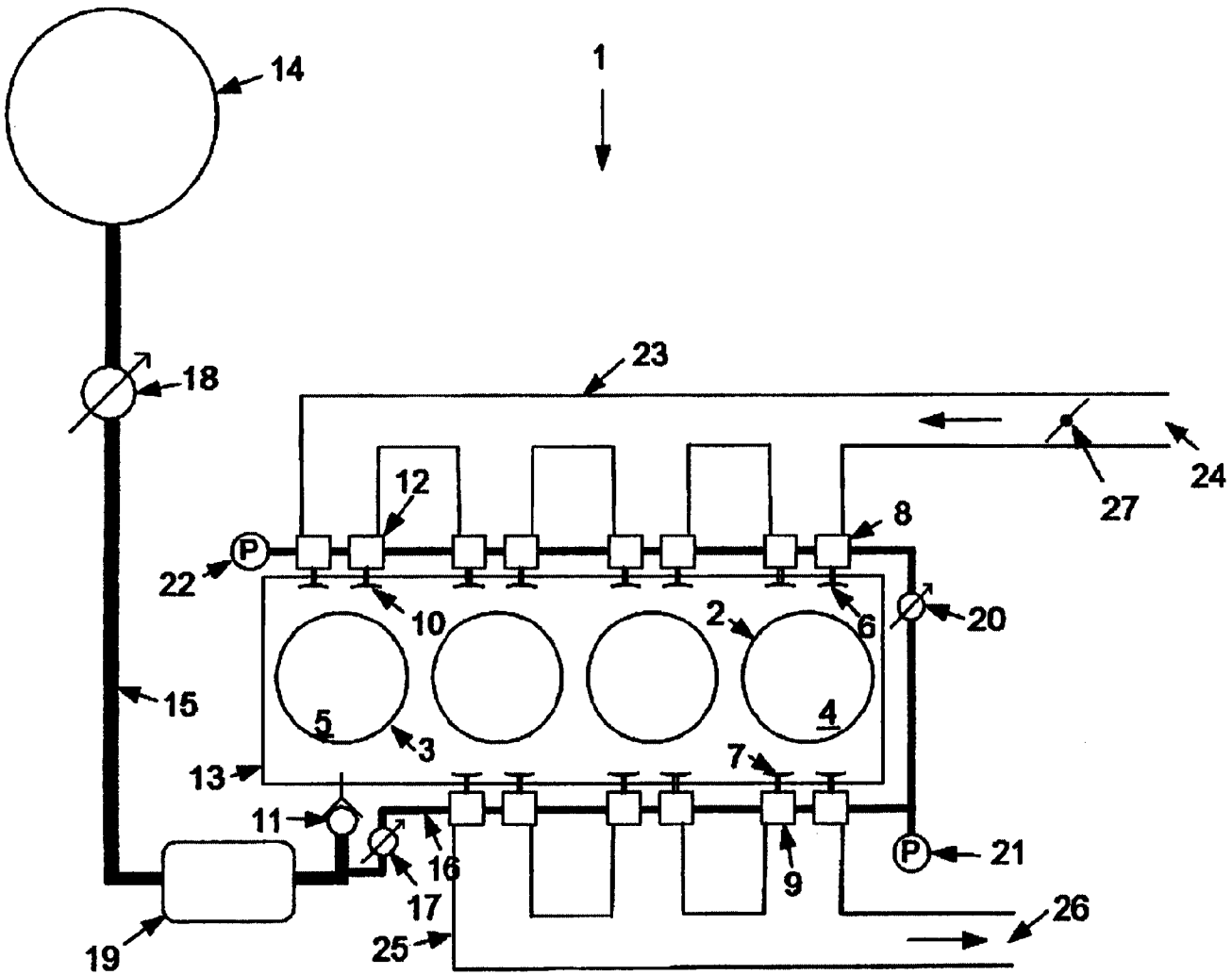
FIG. 1 is a schematic illustration of the inventive internal combustion engine according to a first embodiment.

Reference at first hand is made to FIG. 1, in which is shown an inventive internal combustion engine, generally designated 1, according to a first embodiment. The internal combustion engine 1 comprises at least one working cylinder 2 and at least one compressor cylinder 3. In the shown embodiment the internal combustion engine 1 comprises three working cylinders and one compressor cylinder, however, this ratio may be any other if the specific application so admit or demands. The working cylinder 2 comprises a working piston 4 movably arranged in the working cylinder 2, which working piston 4 is arranged to increase and decrease, respectively, a volume defined jointly by the working cylinder 2 and the working piston 4. Correspondingly the compressor cylinder 3 comprises a working piston 5 movably arranged in the compressor cylinder 3.

Furthermore, the working cylinder 2 comprises a first inlet opening and a first inlet valve 6 arranged to open and close said first inlet opening, an outlet opening and an outlet valve 7 arranged to open and close said outlet opening. In the shown embodiment said first inlet opening is constituted by two physical openings and said inlet valve 6 is constituted by two physical valves, and correspondingly said outlet opening is constituted by two physical openings and said outlet valve 7 is constituted by two physical valves. Moreover, the working cylinder 2 comprises a first pneumatic inlet valve actuator 8 operating the first inlet valve 6 of the working cylinder 2, and a pneumatic outlet actuator 9 operating the outlet valve 7 of the working cylinder 2.

The compressor cylinder 3 comprises a first inlet opening and a first inlet valve 10 arranged to open and close said first inlet opening, an outlet opening and an outlet valve 11 arranged to open and close said outlet opening. In the shown embodiment said first inlet opening is constituted by two physical openings and said inlet valve 10 is constituted by two physical valves. The outlet valve 11 of the compressor cylinder 3 is preferably constituted by a non return valve that prevents reflow through the outlet opening of the compressor cylinder 3. Thereto, the outlet opening of the compressor cylinder 3 may be constituted by several physical openings having corresponding outlet valves 11, or by several physical openings having one common outlet valve 11. Thereto, the compressor cylinder 3 preferably comprises a first pneumatic inlet valve actuator 12 operating the first inlet valve 10 of the compressor cylinder 3, alternatively, the first inlet valve 10 of the compressor cylinder 3 may be constituted by a non return valve preventing reflow out through the inlet opening of the compressor cylinder 3.

In the shown embodiment the internal combustion engine 1 comprises a common cylinder block 13 housing the working cylinder 2 as well as the compressor cylinder 3. In an alternative embodiment, not shown, the internal combustion engine comprises two separate cylinder blocks, a first housing the working cylinder 2 and a second housing the compressor cylinder 3. correspondingly the internal combustion engine 1 comprises common or divided cylinder head (not shown). In the shown embodiment the internal combustion engine 1 comprises one crank shaft (not shown) connected to the working piston 4 as well as the compressor piston 5, which is suitable when a common cylinder block is used. It shall be pointed out that it is central for the invention that the working piston 4 is operatively connected to and operates the compressor piston 5, and thus divided crankshaft, cylinder block and/or cylinder head may be used as long as a transmission of motion is present between the working piston 4 and the compressor piston 5. It shall be pointed out that it is advantageous to use a common crankshaft, cylinder block and cylinder head as the number of parts is kept to a minimum at the same time as for instance cooling of the different parts of the internal combustion engine is facilitated. In order to minimize possible vibrations of the internal combustion engine 1 the crankshaft solution should be configured such that the pressure in the compressor cylinder 3 is high when the pressure in the working cylinder 2 is high during an expansion stroke. However, in reality the pressure in the compressor cylinder 3 is increasing at the same time as the pressure in the working cylinder 2 decreases, which result in that an angular displacement between the compressor piston 5 and the working piston 4 has to be optimized in order to minimize the unbalance in the combustion pulse pattern of the internal combustion engine 1.

Problems of vibrations due to unbalance in combustion pulse pattern is specifically appear in internal combustion engines 1 comprising several working cylinders 2 and one compressor cylinder 3, since the compression pulse moment of the compressor cylinder 3 does not fit into the combustion pulse pattern of the working cylinders 2.

Preferably the angular displacement between the upper turning point of the working piston 4 that is located nearest the compressor piston 5 and the upper turning point of said compressor piston 5 should be more than 30 degrees, more preferably more than 40 degrees, at the same time as said angular displacement preferably should be less than 90 degrees, more preferably less than 80 degrees, wherein the movement of said working piston 4 is ahead of the movement of the compressor piston 5. Moreover, the combustion pulse moment of the strokes of said working cylinder 2 coinciding with the strokes of the compressor cylinder 3 may be increased, which result in that the pulse moment going to the crankshaft becomes unchanged as if the compression pulse moment of the stroke of the compressor cylinder 3 is not performed and the combustion pulse moment of the stroke of the working cylinder 2 is not increased. It shall be pointed out that all other working cylinders may work as usual having unchanged combustion pulse moment. Thus, preferably strokes of the compressor cylinder 3 should be performed at the same time as strokes of said working cylinder 2 are performed in order to obtain en evening out of the pulse moment in the internal combustion engine 1, i.e. when the working cylinder 2 works in four-stroke the compressor cylinder 3 should also be driven in four-stroke.

Moreover, the internal combustion engine 1 comprises a compressed-air tank 14 connected to the first inlet opening of the compressor cylinder 3 via a first compressed-air conduit 15, and a second compressed-air conduit 16 that extends from said first compressed-air conduit 15 and that comprises a first flow valve 17 arranged to open and close fluid communication from said first compressed-air conduit 15 to said second compressed-air conduit 16. Said first flow valve 17 is preferably a maneuverable flow valve. The second compressed-air conduit 16 is connected to the pneumatic outlet valve actuator 9 and the first pneumatic inlet valve actuator 8 of the working cylinder 2, as well as to the firsts pneumatic valve actuator 12 of the compressor cylinder 3.

Preferably the first compressed-air conduit 15 comprises a maneuverable flow valve 18 that is located between the outlet valve 11 of the compressor cylinder 3 and the compressed-air tank 14 and that is arranged to open and close fluid communication between the compressed-air tank 14 and the outlet opening of the compressor cylinder 3. An advantage of having a maneuverable flow valve 18 is that it is open when the compressor cylinder 3 produces higher pressure than the pressure that is used by the inlet valve actuators and the outlet valve actuators and thus admits storage of compressed-air, or when the pressure produced by the compressor cylinder 3 is lower than the pressure used by the inlet valve actuators and the outlet valve actuators and thus admits use of the stored compressed-air. Thereto, the maneuverable flow valve 18 is closed when the pressure in the compressed-air tank 14 is higher than the pressure produced by the compressor cylinder 3, as long as the pressure produced by the compressor cylinder 3 is higher than the pressure used by the inlet valve actuators and the outlet valve actuators.

Preferably the first compressed-air conduit 15 comprises a regenerator 19 that is located between the outlet valve 11 of the compressor cylinder 3 and the compressed-air tank 14. When the compressed-air is led from the compressor cylinder 3 to the compressed-air tank 14 the regenerator 19 is heated by and stores the heat generated in the compressed-air produced by the compressor cylinder 3. An advantage of the regenerator 19 is that compressed-air that reaches the compressed-air tank 14 has been cooled down which admits a larger volume of compressed-air to be stored in a compressed-air tank 14 of a given volume than if the compressed-air would not have been cooled down. Preferably the second compressed-air conduit 16 is connected to the first compressed-air conduit 15 between the regenerator 19 and the outlet valve 11 of the compressor cylinder 3. The advantage of this configuration is that when the stored compressed-air is allowed to flow from the compressed-air tank 14 and into the second compressed-air conduit 16 the compressed-air passes through the regenerator 19 and is heated and thereby increasing the volume of the compressed-air, this result in that the compressed-air lasts to more activations of the inlet valve actuators and/outlet valve actuators than if the compressed-air would not have been heated. A non shown alternative/supplementary solution to the use of said regenerator is that the compressed-air tank 14 comprises a porous material arranged to absorb the heat generated in the compresses-air created by the compressor cylinder 3, which admit that more compressed-air can be stored in the compressed-air tank 14.

Preferably the second compressed-air conduit 16 comprises a second flow valve 20, the pneumatic outlet valve actuator 9 of the working cylinder 2 being located upstream said second flow valve 20, and the first pneumatic inlet valve actuator 8 of the working cylinder 2 and the first pneumatic inlet valve actuator 12 of the compressor cylinder 3 being located downstream said second flow valve 20. Preferably the second flow valve 20 is constituted by a maneuverable flow valve. Moreover, it is preferred that the second compressed-air conduit 16 comprises a first pressure sensor 21 and a second pressure sensor 22, the first pressure sensor 21 being located between the first flow valve 17 and the second flow valve 20 and the second pressure sensor 22 being located downstream the second flow valve 20. Preferably the first pressure sensor 21 is located between the outlet valve actuator 9 of the working cylinder 2 and the second flow valve 20, and the second pressure sensor 22 is preferably located downstream the first inlet valve actuator 8 of the working cylinder 2 and the first inlet valve actuator 12 of the compressor cylinder 3, in order to secure that correct pressure is obtained at the outlet valve actuators and the inlet valve actuators, respectively. The use of the second flow valve 20 entail that a higher pressure can be maintained upstream thereof than downstream thereof, which is desirable when inwardly opened inlet valves and outlet valves are used, since upon opening of the outlet valves usually a higher pressure is present in the cylinders than upon opening of the inlet valves. The first pressure sensor 21 and the second pressure sensor 22 can be used to discover possible defects of the inlet valve actuators and the outlet valve actuators.

Moreover, the internal combustion engine 1 comprises a first inlet manifold 23 this is direct of indirect connected to an air inlet 24, and an outlet manifold 25 that is direct or indirect connected to an exhaust gas pipe 26. In the shown embodiment a throttle 27 is located between the first inlet manifold 23 and the air inlet 24, and thereto the first inlet opening of the working cylinder 2 and the first inlet opening of the compressor cylinder 3 are connected to the first inlet manifold 23, and the outlet opening of the working cylinder 2 is connected to the outlet manifold 25.

Figure 2:
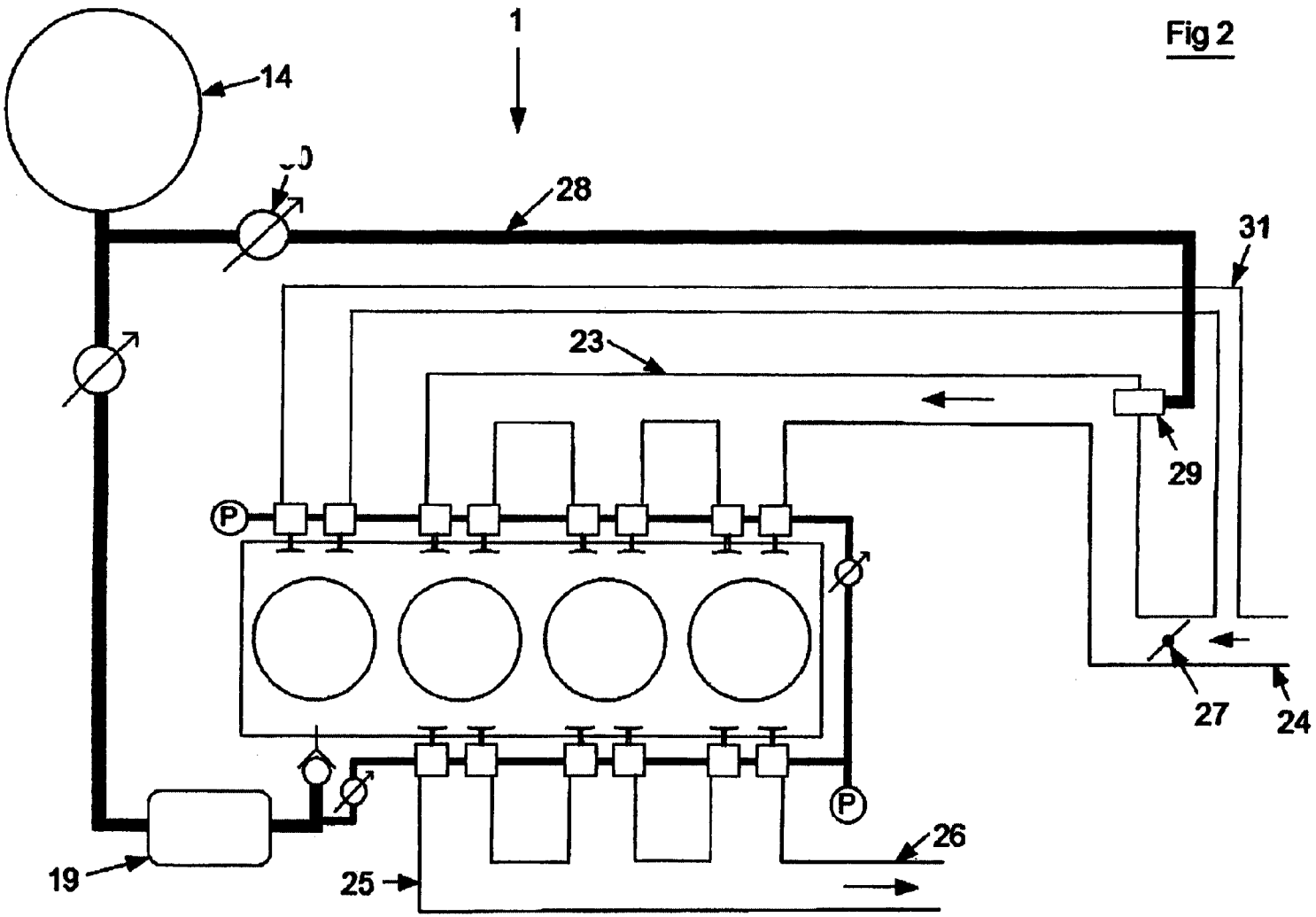
FIG. 2 is a schematic illustration of the inventive internal combustion engine according to a second embodiment.
Figure 3:
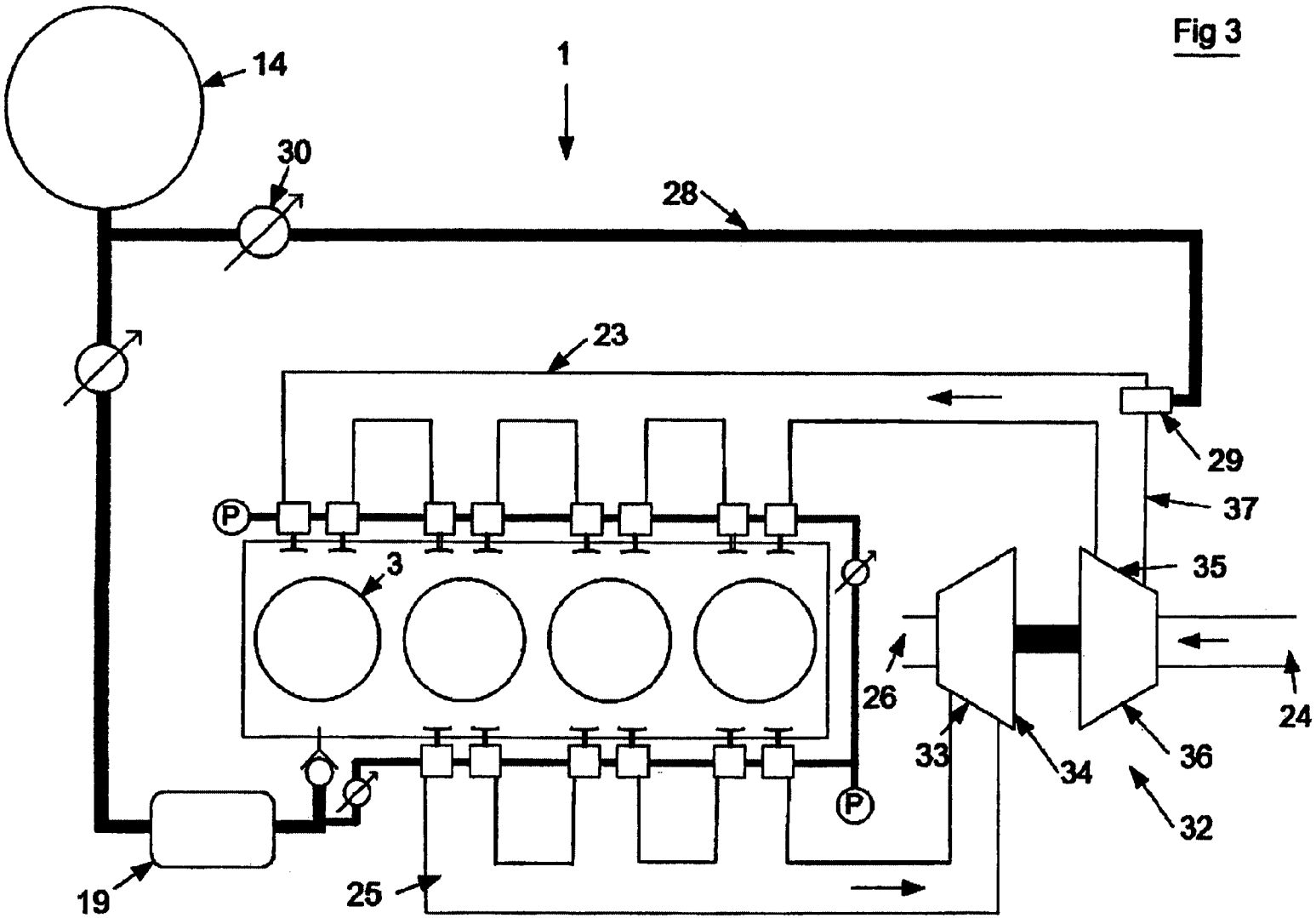
FIG. 3 is a schematic illustration of the inventive internal combustion engine according to a third embodiment.

Reference is now also made to FIGS. 2 and 3, in which a second and a third embodiment, respectively, of the inventive internal combustion engine 1 are shown.

The shown embodiments comprises a third compressed-air conduit 28 that extends from the compressed-air tank 14 to an ejector nozzle, or compressed-air nozzle, 29, and that comprises a maneuverable flow valve 30 arranged to open and close fluid communication from the compressed-air tank 14 to the ejector nozzle 29. The ejector nozzle 29 mouth in the first inlet manifold 23 and is directed in the flow direction of the inlet air. The compressed-air led via the third compressed-air conduit 28 from the compressed-air tank 14 is in the preferred embodiment cool down, such as described above in connection with FIG. 1 and the regenerator 19. Compressed-air is led into the first inlet manifold 23 via the ejector nozzle 29 in order to increase the fill rate of the working cylinder (see FIG. 2), alternatively in the working cylinder 2 and the compressor cylinder 2 (see FIG. 3), which lead to a super charge effect of the internal combustion engine 1 in both embodiments. Cooled down compressed-air gives additional higher fill ratio than warm compressed-air.

In the second embodiment according to FIG. 2 the first inlet opening of the compressor cylinder 3 is connected to the air inlet 24 via a first inlet supply conduit 31, instead of via the first inlet manifold 23 as shown in the third embodiment according to FIG. 3. This result in that supply of air to the compressor cylinder 3 is not choked by the throttle 27 when the driver does not step on the gas.

In the third embodiment the internal combustion engine 1 comprises a super charger, generally designated 32. It shall be pointed out that the third embodiment may comprise a throttle 27 according to the second embodiment instead of the super charger 32. In the shown embodiment the outlet manifold 25 is connected to an inlet 33 of a turbine housing 34 of the super charger 32, and the first inlet manifold 23 is connected to an outlet 35 of a compressor housing 36 of the super charger 32 via a second air supply conduit 37. Thereto an inlet of the compressor housing 36 of the super charger 32 is connected to the air inlet 24, and an outlet of the turbine housing 34 of the super charger 32 is connected to the exhaust gas pipe 26. The third embodiment admit that a super charger 32 optimized for large exhaust gas flows can be used without having an delay of the super charging taking place, thanks to the presence of the ejector nozzle 29 that can be activated synchronously as the driver steps on the gas and thereby generates a super charger effect before the super charger 32 has been fully activated.

Figure 4:
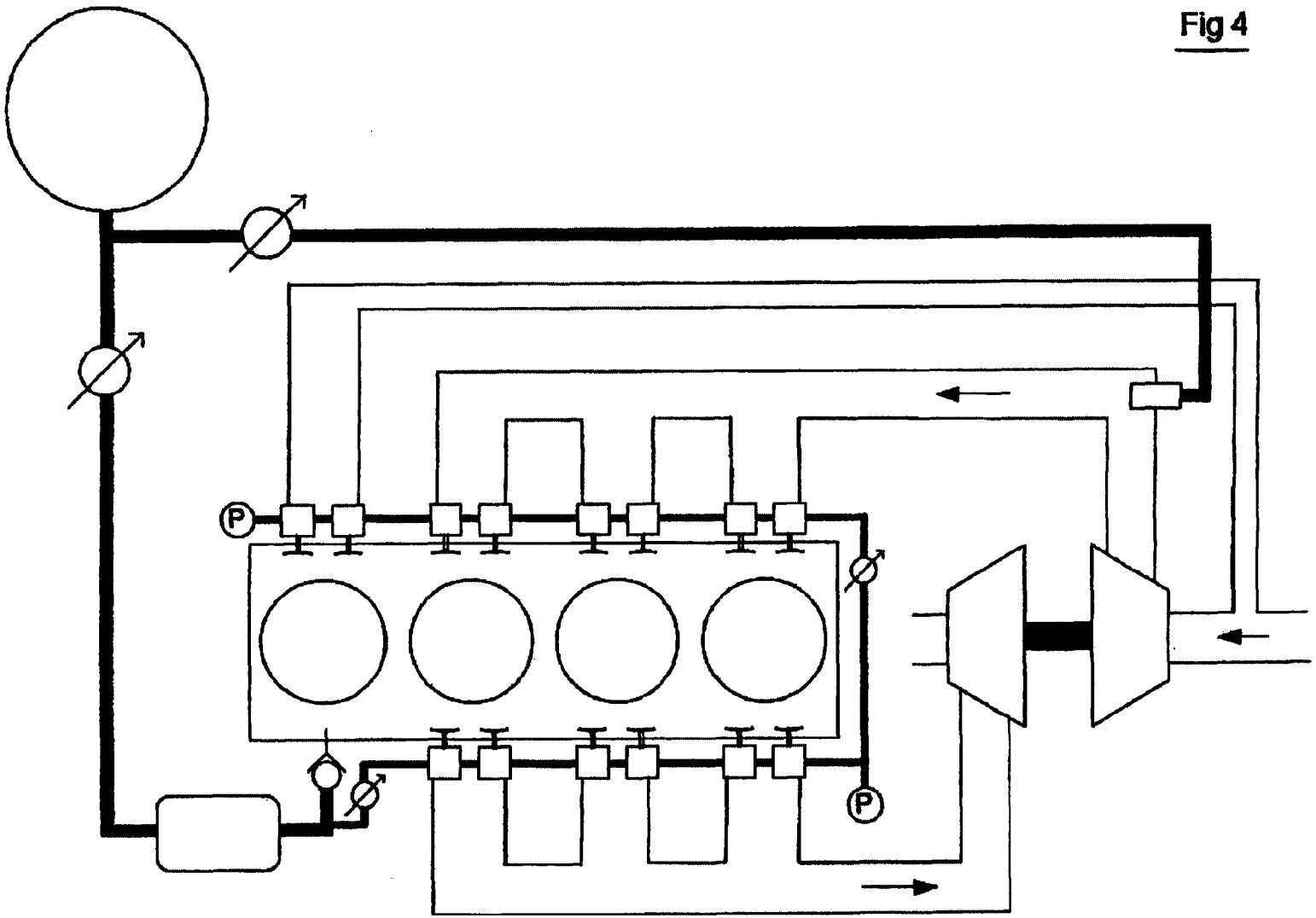
FIG. 4 is a schematic illustration of the inventive internal combustion engine according to a forth embodiment, which is a combination of the internal combustion engines according to FIGS. 2 and 3.

Reference is now also made to FIG. 4, in which is shown a forth embodiment, which is a combination of the internal combustion engines according to FIG. 2 and FIG. 3.

Figure 5:
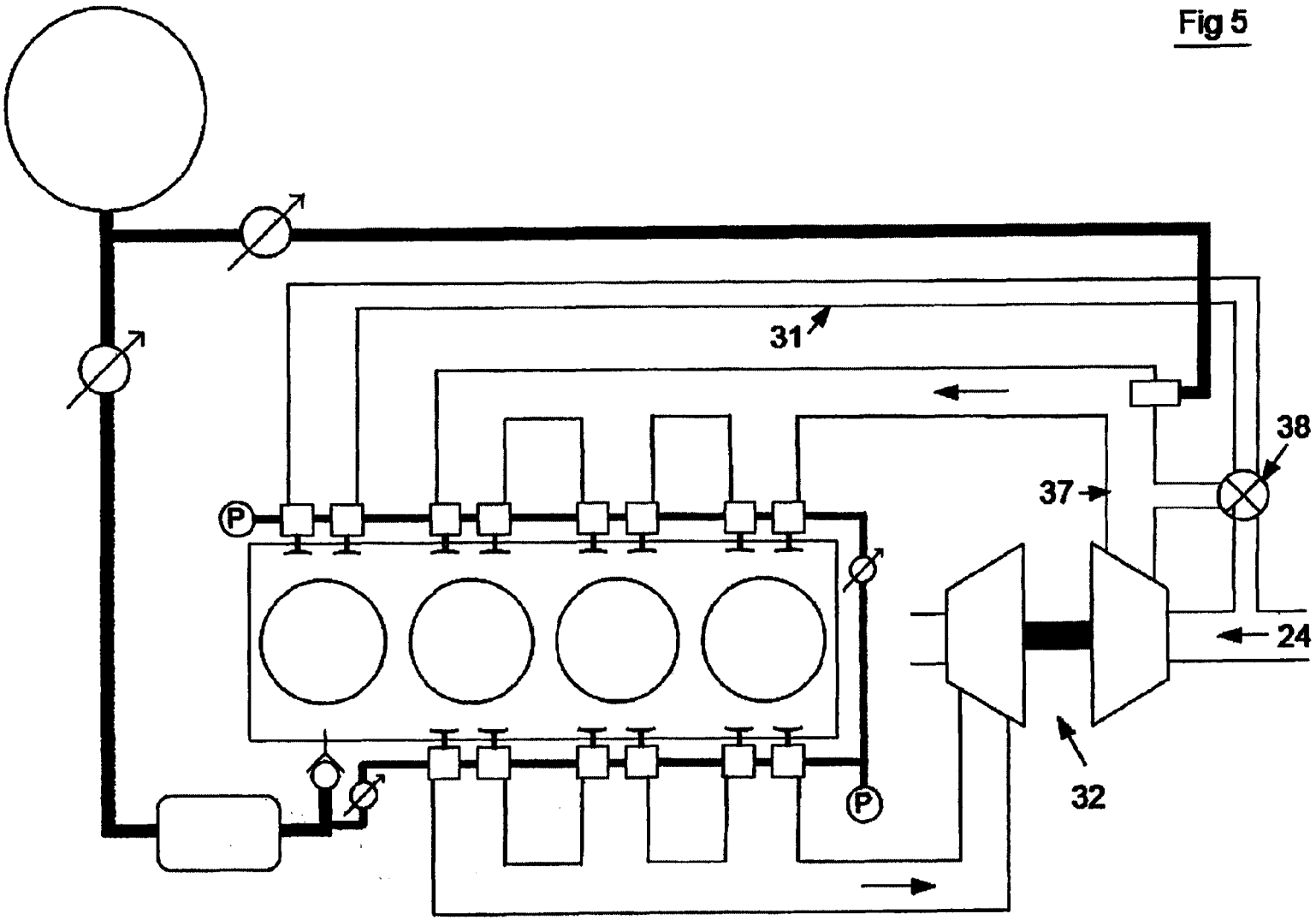
FIG. 5 is a schematic illustration of the inventive internal combustion engine according to a fifth embodiment, which is a combination of the internal combustion engines according to FIGS. 3 and 4.

Reference is now also made to FIG. 5, in which is shown a fifth embodiment, which is a combination of the internal combustion engines according to FIG. 3 and FIG. 4. In addition to what have been described in connection with FIGS. 2-4, the first air supply conduit 31 comprises a maneuverable flow distribution valve 38 that is connected to the second air supply conduit 37 and that is arranged to alternating admit flow communication between the first inlet opening of the compressor cylinder 3 and the air inlet 24, and the first inlet opening of the compressor cylinder 3 and the air supply conduit 37, respectively. This entail that the compressor cylinder 3 can be fed with the air source, air inlet 24 or the super charger 32, having the highest or the most suitable pressure at the moment. Thereto, it is preferred that when the flow distribution valve 38 admits fluid communication between the first inlet opening of the compressor cylinder 3 and the air inlet 24 fluid communication is also admitted between the air inlet 24 and the second air supply conduit 37. This entail that an under-pressure does not arise in the second air supply conduit 37 before the super charger 32 has been fully activated, i.e. during the period the ejector nozzle 29 is activated and the super charger 32 thereby runs the risk of choking the flow created by the ejector nozzle 29.

Figure 6:
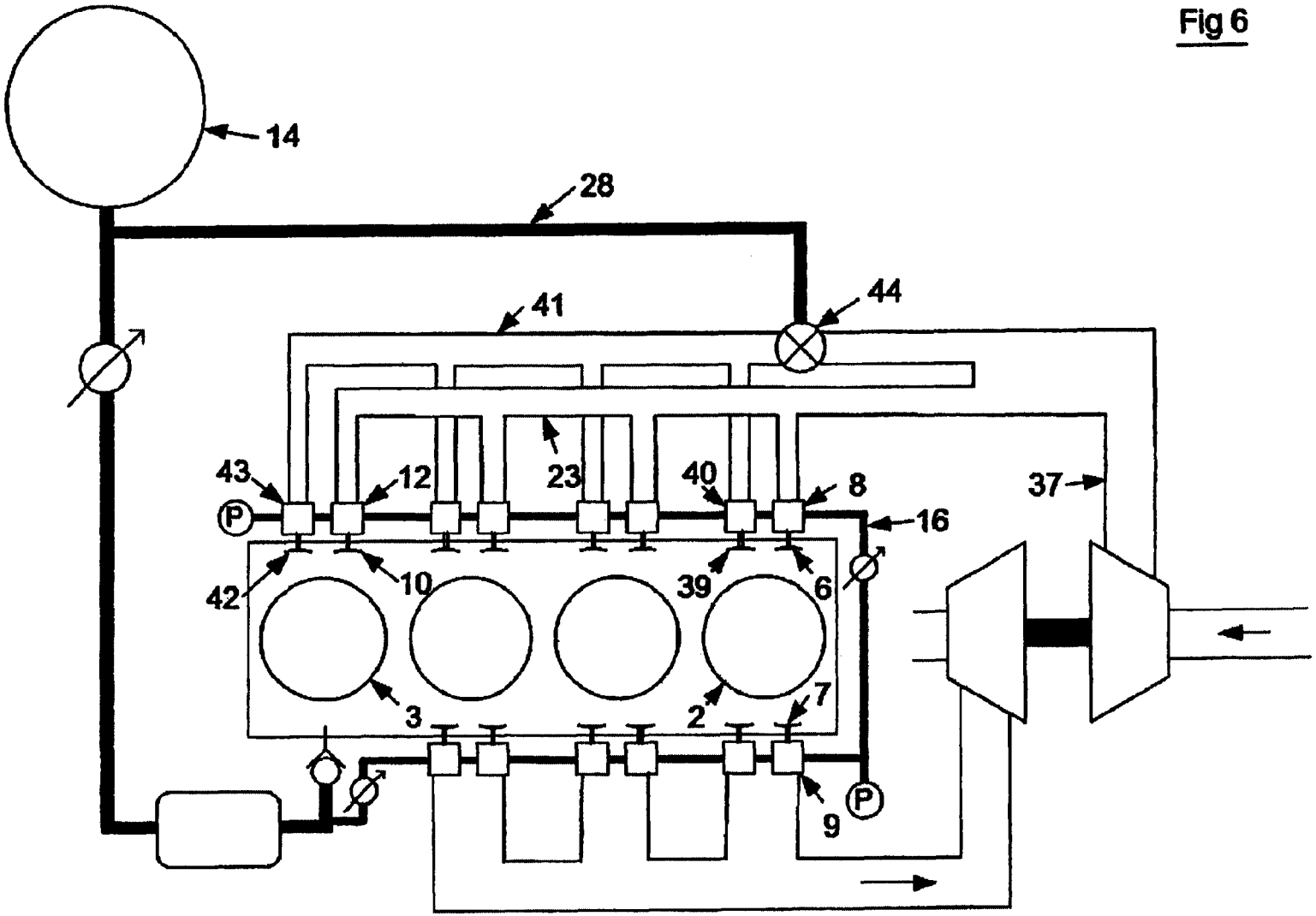
FIG. 6 is a schematic illustration of the inventive internal combustion engine according to a sixth embodiment.

Reference is now also made to FIG. 6, in which a sixth embodiment of the inventive internal combustion engine is shown. It shall be pointed out that the sixth embodiment is a further development of the third embodiment, why only new details are described hereinafter.

In the shown embodiment the working cylinder 2 comprises a second inlet opening and a second inlet valve 39 arranged to open and close said second inlet opening. The second inlet valve 39 of the working cylinder 2 is operated by a second inlet valve actuator 40 that is connected to the second compressed-air conduit 16, and said second inlet valve 39 is connected to a second inlet manifold 41. Preferably also the compressor cylinder 3 comprises a second inlet opening and a second inlet valve 42 arranged to open and close said second inlet opening. The second inlet valve 42 of the compressor cylinder 3 is operated by second inlet valve actuator 42 that is connected to the second compressed-air conduit 16, and said second inlet valve 42 is connected to the second inlet manifold 41.

The second inlet manifold 41 is connected to the second air supply conduit 37 via a maneuverable flow distribution valve 44, the third compressed-air conduit 28 extending from the compressed-air tank 14 to said maneuverable flow distribution valve 44 that is arranged to alternating admit flow communication between the second air supply conduit 37 and the second inlet manifold 41 and the compressed-air tank 14 and the second inlet manifold 41, respectively. This configuration result in that the stores compressed-air in the compressed-air tank 14 can be used to be expanded in the working cylinder 2 and thus propel the internal combustion engine 1. In the shown embodiments also the compressor cylinder 3 is used to expand the compresses-air stored in the compressed-air tank 14.

Figure 7:
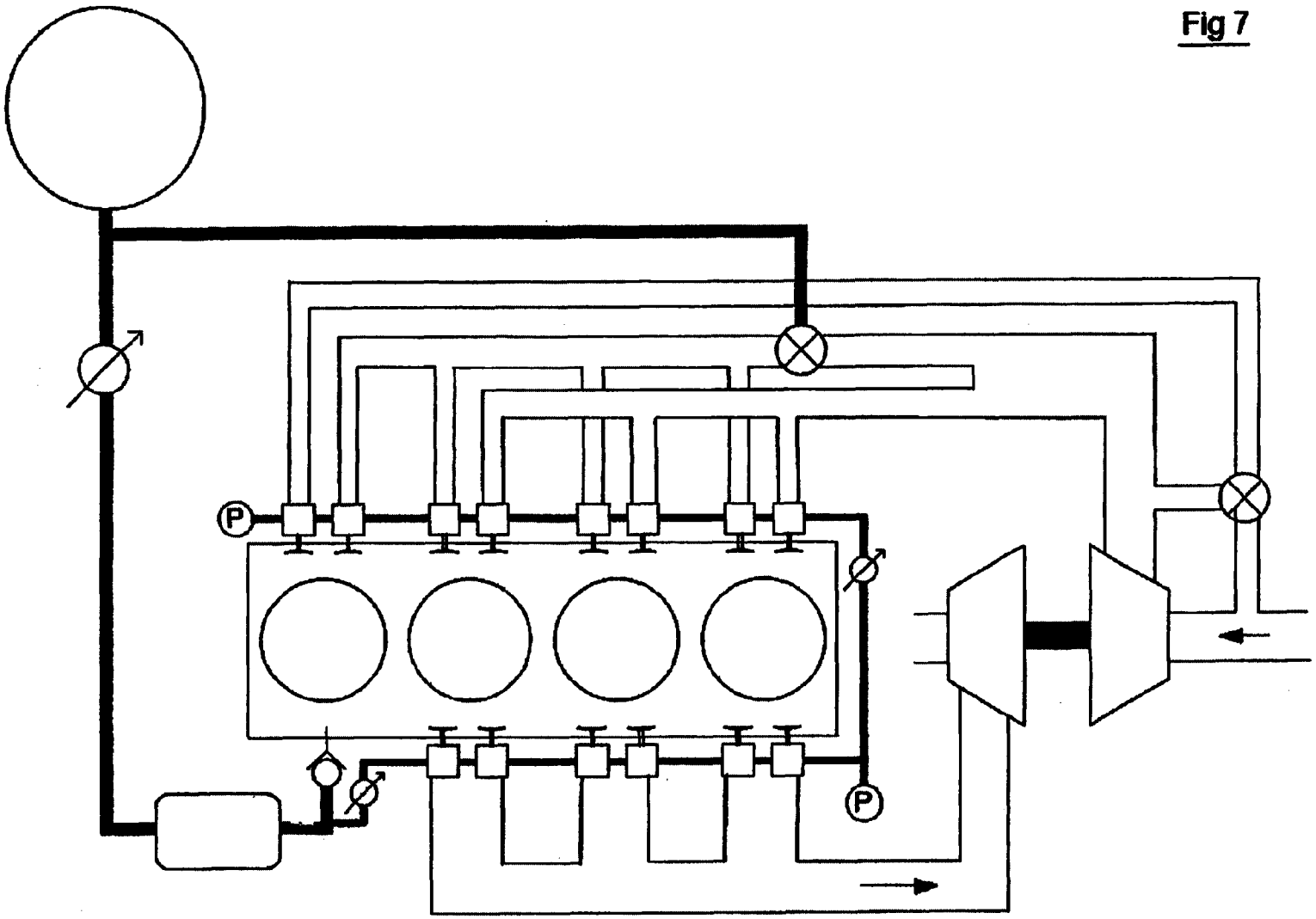
FIG. 7 is a schematic illustration of the inventive internal combustion engine according to a seventh embodiment, which is a combination of the internal combustion engines according to FIGS. 5 and 6.

Reference is now made to FIG. 7, in which is shown a seventh embodiment that is a combination of the internal combustion engines according to FIG. 5 and FIG. 6. In other words the seventh embodiment comprises all advantages of the other shown embodiments.

Common for all embodiments is that every single working cylinder of the internal combustion engine can be operated in two-stroke, four-stroke, any other stroke ratio, strokes having fully or partly closed inlet valves, or a mixture thereof.

Feasible Modifications of the Invention

The invention is not limited only to the embodiments described above and shown in the drawings, which primarily have an illustrative and exemplifying purpose. This patent application is intended to cover all adjustments and variants of the preferred embodiments described herein, thus the present invention is defined by the wording of the appended claims and the equivalents thereof. Thus, the equipment may be modified in all kinds of ways within the scope of the appended claims.

It shall also be pointed out that although the terms "cylinders and pistons" for sake of simplicity have been used in the claims as well as in the description, it shall be realized that also other types of arrangements arranged to alternating compress and expand a volume are included.

It shall also be pointed out that even thus it is not explicitly stated that features from a specific embodiment may be combined with features from another embodiment, the combination shall be considered obvious, if the combination is possible.

The invention claimed is:

1. Internal combustion engine for a vehicle, comprising at least two cylinders, a moveably arranged piston being arranged in each cylinder in order to increase and decrease, respectively, a volume defined jointly by the cylinder and the piston, and a compressed-air tank (14) connected to at least one of said at least two cylinders, characterized in that said at least two cylinders comprises at least one working cylinder (2) and at least one compressor cylinder (3), the working cylinder (2) comprising a first inlet opening and a first inlet valve (6) arranged to open and close said first inlet opening, a first pneumatic inlet valve actuator (8) operating the first inlet valve (6), an outlet opening and an outlet valve (7) arranged to open and close said outlet opening, a pneumatic outlet valve actuator (9) operating said outlet valve (7), and a working piston (4) moveably arranged in the working cylinder (2), the compressor cylinder (3) comprising a first inlet opening and a first inlet valve (10) arranged to open and close said first inlet opening, an outlet opening and an outlet valve (11) arranged to open and close said outlet opening, and a compressor piston (5) moveably arranged in the compressor cylinder (3) and operatively connected to and operated by the working piston (4), the compressed-air tank (14) is connected to the outlet opening of the compressor cylinder (3) via a first compressed-air conduit (15), the internal combustion engine (1) also comprising a second compressed-air conduit (16) that extends from said first compressed-air conduit (15) and that comprise a first flow valve (17) arranged to open and close the fluid communication from said first compressed-air conduit (15) to said second compressed-air conduit (16), the first inlet valve actuator (8) and the outlet valve actuator (9) of the working cylinder (2) being connected to the second compressed-air conduit (16).

2. Internal combustion engine according to claim 1, wherein the compressor cylinder (3) also comprises a first pneumatic inlet valve actuator (12) operating the first inlet valve (10), said first inlet valve actuator (12) of the compressor cylinder (3) being connected to the second compressed-air conduit (16).

3. Internal combustion engine according to claim 2, wherein the first compressed-air conduit (15) comprises a maneuverable flow valve (18) that is located between the outlet valve (11) of the compressor cylinder (3) and the compressed-air tank (14) and that is arranged to open and close the fluid communication between the compressed-air tank (14) and the outlet opening of the compressor cylinder (3).

4. Internal combustion engine according to claim 2, wherein the first compressed-air conduit (15) comprises a regenerator (19) that is located between the outlet valve (11) of the compressor cylinder (3) and the compressed-air tank (14).

5. Internal combustion engine according to claim 2, wherein the second compressed-air conduit (16) comprises a second flow valve (20), the outlet valve actuator (9) of the working cylinder (2) being arranged upstream said second flow valve (20), and the first inlet valve actuator (8) of the working cylinder (2) and the first inlet valve actuator (12) of the compressor cylinder (3) being arranged downstream said second flow valve (20).

6. Internal combustion engine according to claim 1, wherein the first compressed-air conduit (15) comprises a maneuverable flow valve (18) that is located between the outlet valve (11) of the compressor cylinder (3) and the compressed-air tank (14) and that is arranged to open and close the fluid communication between the compressed-air tank (14) and the outlet opening of the compressor cylinder (3).

7. Internal combustion engine according to claim 6, wherein the first compressed-air conduit (15) comprises a regenerator (19) that is located between the outlet valve (11) of the compressor cylinder (3) and the compressed-air tank (14).

8. Internal combustion engine according to claim 1, wherein the first compressed-air conduit (15) comprises a regenerator (19) that is located between the outlet valve (11) of the compressor cylinder (3) and the compressed-air tank (14).

9. Internal combustion engine according to claim 8, wherein the second compressed-air conduit (16) is connected to the first compressed-air conduit (15) between the regenerator (19) and the outlet valve (11) of the compressor cylinder (3).

10. Internal combustion engine according to claim 1, wherein the second compressed-air conduit (16) comprises a second flow valve (20), the outlet valve actuator (9) of the working cylinder (2) being arranged upstream said second flow valve (20), and the first inlet valve actuator (8) of the working cylinder (2) and the first inlet valve actuator (12) of the compressor cylinder (3) being arranged downstream said second flow valve (20).

11. Internal combustion engine according to claim 1, wherein the first inlet opening of the working cylinder (2) is connected to a first inlet manifold (23), in which an ejector nozzle (29) mouths, a third compressed-air conduit (28) extends from the compressed-air tank (14) to said ejector nozzle (29), said third compressed-air conduit comprising a maneuverable flow valve (30) that is arranged to open and close fluid communication from the compressed-air tank (14) to the ejector nozzle (29).

12. Internal combustion engine according to claim 11, wherein the first inlet opening of the compressor cylinder (3) is connected to the first inlet manifold (23).

13. Internal combustion engine according to claim 11, wherein the first inlet opening of the compressor cylinder (3) is connected to an air inlet (24) via a first air supply conduit (31).

14. Internal combustion engine according to claim 13, wherein the first inlet opening of the working cylinder (2) is connected to the first inlet manifold (23), in that the outlet opening of the working cylinder (2) is connected to an outlet manifold (25), and in that the internal combustion engine (1) also comprises a supercharger (32), furthermore the outlet manifold (25) is connected to an inlet (33) of a turbine housing (34) of the super charger (32), and in that the first inlet manifold (23) is connected to an outlet (35) of a compressor housing (36) of the super charger (32) via a second air supply conduit (37), said first air supply conduit (31) comprising a maneuverable flow distribution valve (38) that is connected to the second air supply conduit (37) and that is arranged to alternating admit flow communication between, the first inlet opening of the compressor cylinder (3) and the air inlet (24), and the first inlet opening of the compressor cylinder (3) and the second air supply conduit (37), respectively.

15. Internal combustion engine according to claim 11, wherein the first inlet opening of the working cylinder (2) is connected to the first inlet manifold (23), in that the outlet opening of the working cylinder (2) is connected to an outlet manifold (25), and in that the internal combustion engine (1) also comprises a super charger (32), the outlet manifold (25) being connected to an inlet (33) of a turbine housing (34) of the super charger (32), and the first inlet manifold (23) is connected to an outlet (35) of a compressor housing (36) of the super charger (32) via a second air supply conduit (37).

16. Internal combustion engine according to claim 15, wherein the working cylinder (2) also comprises a second inlet opening and a second inlet valve (39) arranged to open and close said second inlet opening, which is connected to a second inlet manifold (41), in that the compressor cylinder (3) also comprises a second inlet opening and a second inlet valve (42) arranged to open and close said second inlet opening, which is connected to said second inlet manifold (41), the second inlet manifold (41) being connected to said second air supply conduit (37) via a maneuverable flow distribution valve (44), and a third compressed-air conduit (28) extending from the compressed-air tank (14) to said maneuverable flow distribution valve (44) that is arranged to alternating admit flow communication between, the second air supply conduit (37) and the second inlet manifold (41), and the compressed-air tank (14) and the second inlet manifold (41), respectively.

17. Internal combustion engine according to claim 1, wherein an angular displacement between an upper turning point of the working piston (4) and the upper turning point of the compressor piston (5) is more than 30 degrees, wherein the movement of the working piston (4) is ahead of the movement of the compressor piston (5).

18. Internal combustion engine according to claim 1, wherein an angular displacement between an upper turning point of the working piston (4) and the upper turning point of the compressor piston (5) is less than 90 degrees, wherein the movement of the working piston (4) is ahead of the movement of the compressor piston (5).

19. Internal combustion engine according to claim 1, wherein an angular displacement between an upper turning point of the working piston (4) and the upper turning point of the compressor piston (5) is more than 40 degrees, wherein the movement of the working piston (4) is ahead of the movement of the compressor piston (5).

20. Internal combustion engine according to claim 1, wherein an angular displacement between an upper turning point of the working piston (4) and the upper turning point of the compressor piston (5) is less than 80 degrees, wherein the movement of the working piston (4) is ahead of the movement of the compressor piston (5).

* * * * *